US007424255B2

(12) United States Patent
Sakai

(10) Patent No.: US 7,424,255 B2
(45) Date of Patent: Sep. 9, 2008

(54) DEVICE AND METHOD FOR BELT SPEED CONTROL, AND IMAGE FORMING APPARATUS

(75) Inventor: Yoshihiro Sakai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 358 days.

(21) Appl. No.: 11/282,868

(22) Filed: Nov. 21, 2005

(65) Prior Publication Data

US 2006/0133861 A1 Jun. 22, 2006

(30) Foreign Application Priority Data

Nov. 29, 2004 (JP) ..... 2004-343314

(51) Int. Cl.
*G03G 15/01* (2006.01)

(52) U.S. Cl. ..... 399/301; 399/302; 399/303; 399/396

(58) Field of Classification Search ..... 399/162, 399/167, 299, 301, 302, 303, 308, 312, 329, 399/394, 396; 347/116, 154; 226/27, 28, 226/45; 356/399–401; 700/229, 230; 198/804, 198/832, 810.01

See application file for complete search history.

(56) References Cited

U.S. PATENT DOCUMENTS

| | | | | |
|---|---|---|---|---|
| 5,272,492 | A * | 12/1993 | Castelli | 347/116 |
| 5,383,014 | A | 1/1995 | Nowak et al. | |
| 6,336,019 | B2 * | 1/2002 | Castelli et al. | 399/162 |
| 6,842,602 | B2 * | 1/2005 | Kudo | 399/303 |
| 7,076,195 | B2 * | 7/2006 | Sakai | 399/301 |
| 7,174,237 | B2 * | 2/2007 | Takayama et al. | 700/230 |
| 2004/0022557 | A1 | 2/2004 | Kudo | |
| 2005/0099153 | A1 * | 5/2005 | Komatsu et al. | 318/807 |
| 2006/0280523 | A1 * | 12/2006 | Sakai | 399/167 |

FOREIGN PATENT DOCUMENTS

| | | | |
|---|---|---|---|
| JP | 1-157668 | | 6/1989 |
| JP | 6-113089 | | 4/1994 |
| JP | 7-245682 | | 9/1995 |
| JP | 9-27909 | | 1/1997 |
| JP | 9-172525 | | 6/1997 |
| JP | 9-200449 | | 7/1997 |
| JP | 09175687 | A * | 7/1997 |
| JP | 9-298628 | | 11/1997 |
| JP | 10232566 | A * | 9/1998 |
| JP | 2946520 | | 7/1999 |
| JP | 2001-34025 | | 2/2001 |
| JP | 2001-86341 | | 3/2001 |
| JP | 2004-69933 | | 3/2004 |
| JP | 2004191845 | A * | 7/2004 |
| JP | 3625962 | | 12/2004 |
| JP | 3640287 | | 1/2005 |

* cited by examiner

*Primary Examiner*—Robert Beatty
(74) *Attorney, Agent, or Firm*—Oblon, Spivak, McClelland, Maier & Neustadt, P.C.

(57) ABSTRACT

A scale including equally spaced marks is attached to a belt in a direction of movement of the belt such that a gap is formed between a first end and a second end of the scale. A first sensor and a second sensor detect the marks on the scale and output first signals and second signals respectively upon detecting the marks. The first sensor and the second sensor are located at different positions along the direction. A controlling unit controls the speed based on any one of the first signals and the second signals according to a position of the gap detected by the first sensor and the second sensor.

10 Claims, 11 Drawing Sheets

DEVICE AND METHOD FOR BELT SPEED CONTROL, AND IMAGE FORMING APPARATUS

CROSS-REFERENCE TO RELATED APPLICATIONS

The present document incorporates by reference the entire contents of Japanese priority document 2004-343314 filed in Japan on Nov. 29, 2004.

BACKGROUND OF THE INVENTION

1. Field of the Invention

The present invention relates to a technology for controlling speed of an endless belt by a feedback control performed based on detection of scale marks formed on the belt.

2. Description of the Related Art

An image forming apparatus generally includes a belt-speed control device that controls the speed of an intermediate transfer belt. A plastic scale seal with scale marks is adhered to the periphery of the intermediate transfer belt. A sensor (reflective photosensor) reads the scale marks and outputs detection pulses. Based on the detection pulses, the speed of the intermediate transfer belt is controlled by controlling a belt driving motor that drives the intermediate transfer belt. Thus, the speed of the intermediate transfer belt can be stabilized at an ideal speed.

As a result, variations in the speed of a sheet carrying belt and the intermediate transfer belt can be prevented even in a tandem-type color image forming apparatus including a plurality of photosensitive members 91Y, 91C, 91M, AND 91K, as shown in FIG. 9 and FIG. 10. Consequently, misalignment of toner images can be reliably prevented.

However, there is generally a seam, or a gap, between the front and rear ends of the intermediate transfer belt. Upon encountering the gap, the sensor outputs detection pulses with a wider interval (see FIG. 11) than otherwise (see FIG. 12).

Because of the wider pulses, a control system misjudges that the belt has slowed down, and erroneously performs feedback control to increase the belt speed.

One approach is to control the belt speed by a dummy pulse stored in a RAM, etc., instead of using the pulse output by the sensor when the gap passes under the sensor.

The average interval of the dummy pulses is the same as that of the pulses output by the sensor when reading the scale marks while the intermediate transfer belt is being driven at an ideal speed. Thus, by using this dummy pulse, the belt can be driven at an ideal speed even when the gap is encountering the sensor.

When it is determined from the detection pulses that the gap is encountering the sensor, the control system controls the belt speed by using the dummy pulse. Thus, there is a need to quickly determine that the gap is encountering the sensor.

If there is a delay in determining that the gap is encountering the sensor, the control system might continue using the detection pulse output from the sensor during the delay period and perform feedback control of the belt speed based on the detection pulses. In this case, the belt speed is erroneously increased before employing the dummy pulse. As a result, the belt speed cannot be accurately controlled.

The sensor generally cannot immediately detect the gap when the front end of the scale reaches the sensor. The reason for this is because of the characteristic of an analog voltage output that is output by the sensor upon reading the scale marks of the scale. FIG. 13 depicts the characteristic of the analog voltage output that is output by the sensor upon reading the scale marks of the scale.

An output voltage value $\alpha$ represents the output voltage value when the sensor is reading the scale marks. As the gap reaches the sensor, the voltage gradually drops. When the output voltage drops to a threshold $\beta$ or less, the control system recognizes that the gap region has begun from this point on, and switches to controlling the belt speed based on the dummy pulses instead of the detection pulses.

Accordingly, at the portion marked "x" in FIG. 13, the control system does not implement control using the dummy pulse even though the actual gap region has crossed the sensor. Consequently, the belt speed is controlled inaccurately, resulting in misaligned toner images and leading to degradation of color image.

To solve this problem, a belt-speed control device having two sensors has been proposed. When a first sensor, provided upstream in the direction in which the belt is driven, detects the gap, a second sensor, provided downstream in the direction in which the belt is driven, controls the belt speed.

However, the second sensor takes over the control only after the first sensor recognizes the gap, resulting in the delay as denoted by "x" in FIG. 13. Therefore, the problem remains unsolved.

Japanese Patent Laid-Open Publication No. 2004-69933 discloses two examples of another belt-speed control device. In the first example, the surface of an endless belt is covered with a linear scale (scale seal) having a plurality of timing scale marks (pitches) along the circumferential direction. Three sensors with spaces therebetween in the circumferential direction are provided along the linear scale. Two of the sensors simultaneously read the linear scale and each sensor outputs a signal. A linear encoder receives the signals from both the sensors and synchronizes the pulse timings of the pulse signals of the two sensors. A controller controls the belt speed based on the signal output from the linear encoder.

In a second example of this conventional belt speed detecting device, two linear scales forming two columns in the breadth direction of the endless belt are provided at shifted positions in the circumferential direction of the belt in such a manner that their edges overlap with each other. Two sensors are arranged so that each sensor reads one of the linear scales.

However, in the first example, controlling the speed requires complex software to synchronize the timings of the pulse signals output by the two sensors.

In the second example, the belt must be wide enough to accommodate two linear scales, which makes the scale of the device bigger. Further, arranging the two linear scales perfectly parallel to each other is a difficult task.

SUMMARY OF THE INVENTION

It is an object of the present invention to at least solve the problems in the conventional technology.

According to an aspect of the present invention, a device for controlling speed of a belt, wherein a scale including a plurality of equally spaced marks is attached to the belt in a direction of movement of the belt such that a gap is formed between a first end and a second end of the scale includes a first sensor configured to detect the marks on the scale and output a first signal upon detecting a mark among the marks, a second sensor configured to detect the marks on the scale and output a second signal upon detecting a mark among the marks, wherein the first sensor and the second sensor are located at different positions along the direction, and a controlling unit that controls the speed based on any one of the first signals and the second signals according to a position of the gap detected by the first sensor and the second sensor.

According to another aspect of the present invention, a device for controlling speed of a belt, wherein a scale including a plurality of equally spaced marks is attached to the belt in a direction of movement of the belt such that a gap is formed between a first end and a second end of the scale includes a plurality of sensors configured to detect the marks on the scale and output signals upon detecting the marks, a first sensor among the plurality of sensors that outputs a first signal upon detecting a mark among the marks, a second sensor among the plurality of sensors that outputs a second signal upon detecting a mark among the marks, wherein the first sensor and the second sensor are located at different positions along the direction, and a controlling unit that controls the speed based on any one of the first signals and the second signals according to a position of the gap detected by the first sensor and the second sensor.

According to still another aspect of the present invention, an image forming apparatus includes an image forming unit that forms images by movement of a belt, wherein a scale including a plurality of equally spaced marks is attached to the belt in a direction of movement of the belt such that a gap is formed between a first end and a second end of the scale, and a device that controls speed of the belt, including a first sensor configured to detect the marks on the scale and output a first signal upon detecting a mark among the marks, a second sensor configured to detect the marks on the scale and output a second signal upon detecting a mark among the marks, wherein the first sensor and the second sensor are located at different positions along the direction, and a controlling unit that controls the speed based on any one of the first signals and the second signals according to a position of the gap detected by the first sensor and the second sensor.

According to still another aspect of the present invention, a method for controlling speed of a belt, wherein a scale including a plurality of equally spaced marks is attached to the belt in a direction of movement of the belt such that a gap is formed between a first end and a second end of the scale includes detecting the marks on the scale at a first position, detecting the marks on the scale at a second position, wherein the first position and the second position are located at different positions along the direction, and controlling the speed based on detection results at any one of the first position and the second position according to a position of the gap detected at any one of the first position and the second position.

According to still another aspect of the present invention, a device for controlling speed of a belt, wherein a scale including a plurality of equally spaced marks is attached to the belt in a direction of movement of the belt such that a gap is formed between a first end and a second end of the scale includes first detecting means for detecting the marks on the scale and outputting a first signal upon detecting a mark among the marks, second detecting means for detecting the marks on the scale and outputting a second signal upon detecting a mark among the marks, wherein the first detecting means and the second detecting means are located at different positions along the direction, and controlling means for controlling the speed based on any one of the first signals and the second signals according to a position of the gap detected by the first detecting means and the second detecting means.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
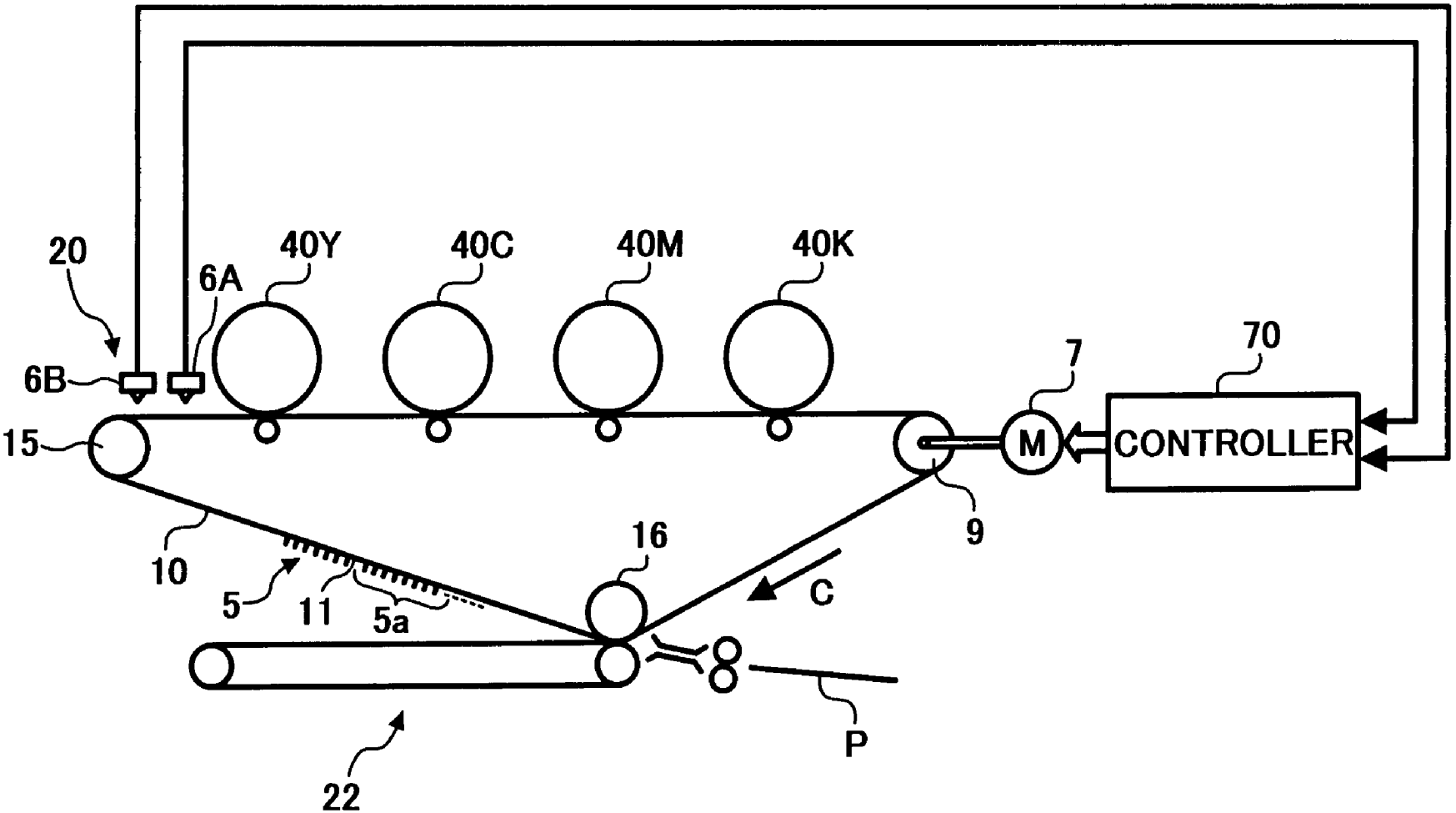
FIG. 1 is a schematic of a belt-speed control device of an image forming apparatus according to an embodiment of the present invention.
Figure 2:
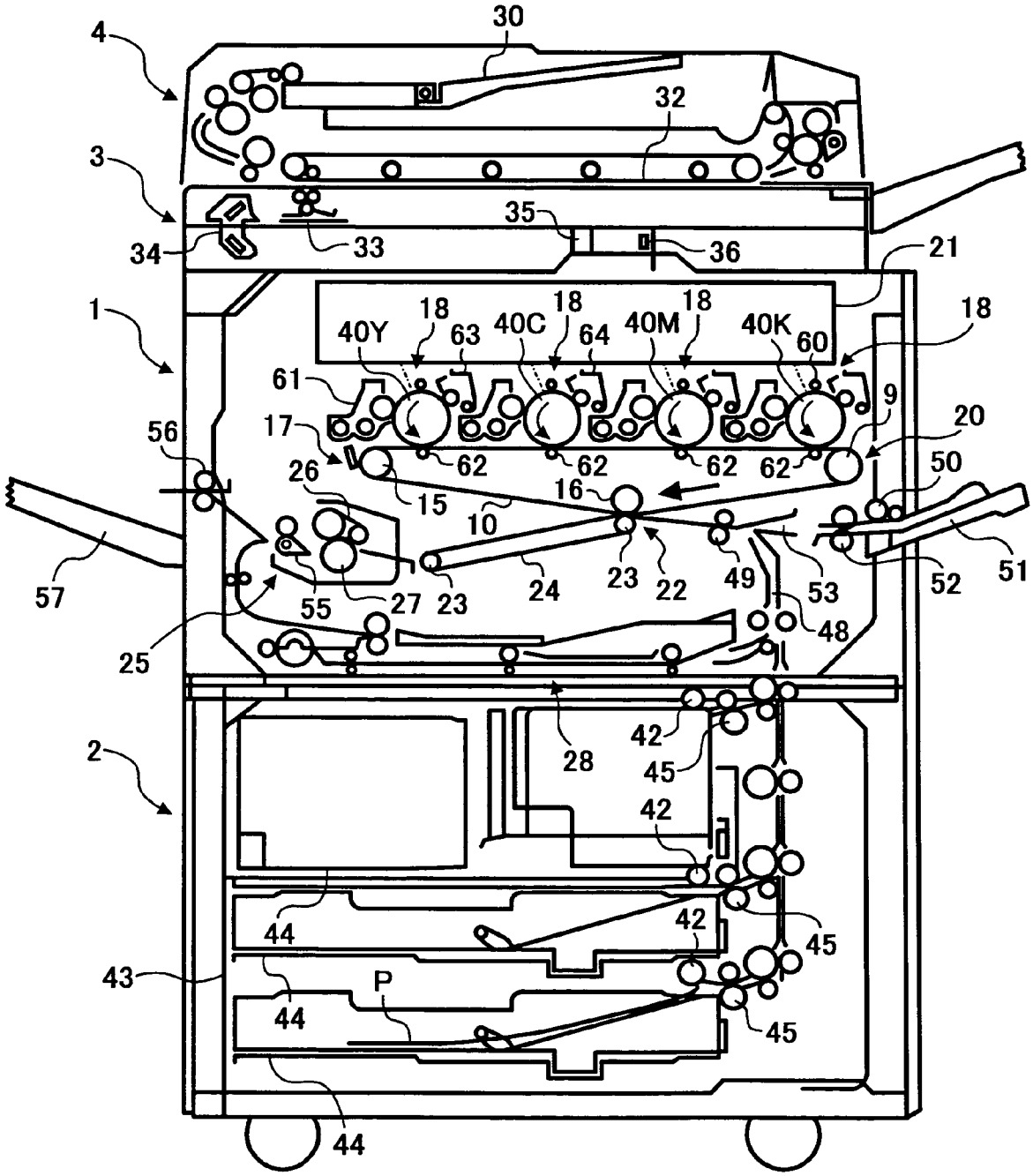
FIG. 2 depicts an overall configuration of the image forming apparatus according to the embodiment.
Figure 3:
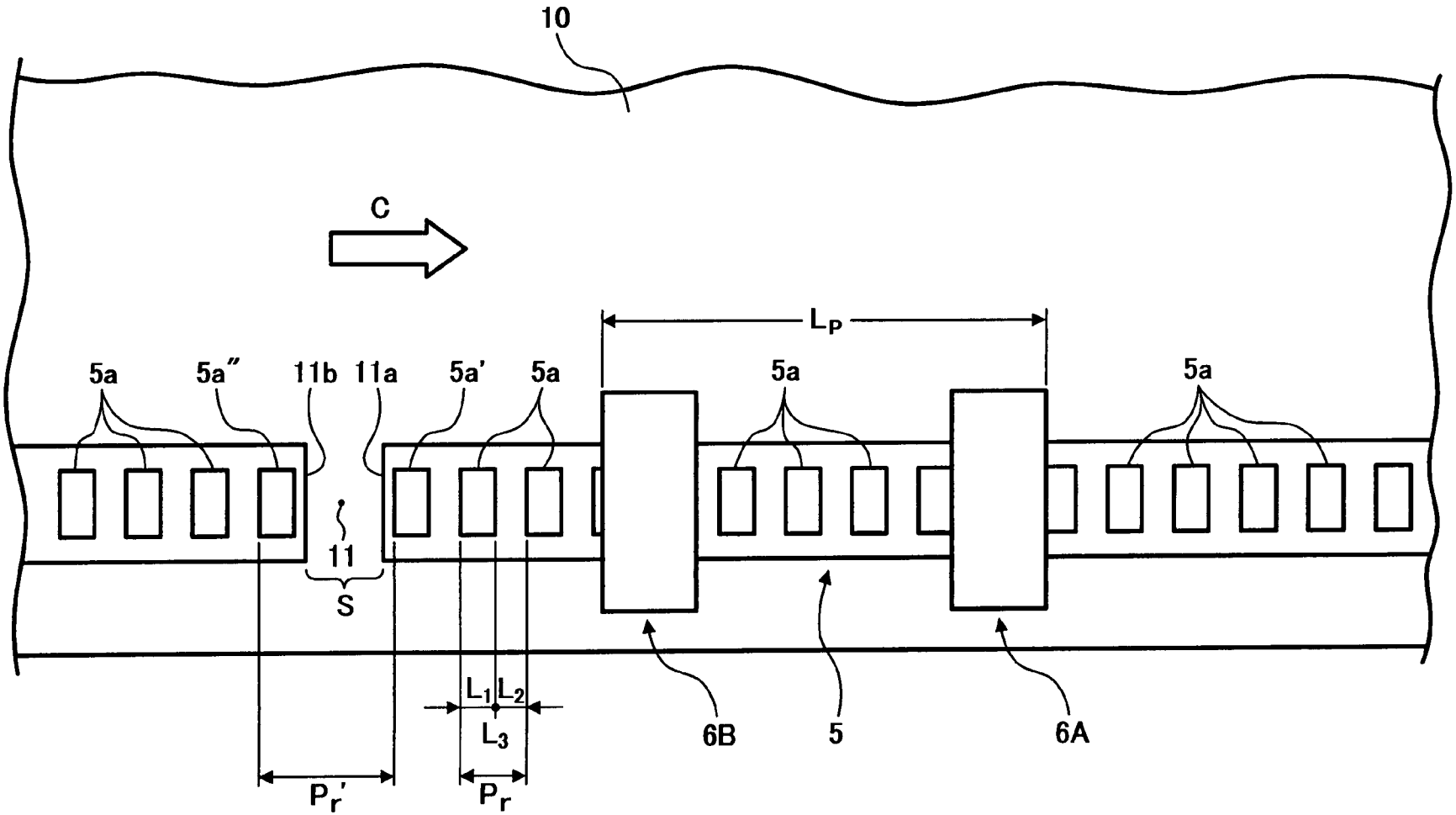
FIG. 3 is a top view of the belt-speed control device shown in FIG. 1 including two sensors.

FIG. 1 is a schematic diagram of a belt-speed control device of an image forming apparatus according to an embodiment of the present invention. FIG. 2 depicts an overall structure of the image forming apparatus according the embodiment. FIG. 3 is a top view of the belt-speed control device including two sensors that read scale marks provided on an intermediate transfer belt.

In FIG. 2, a color copier is presented as an example of the image forming apparatus. The color copier is a tandem image forming apparatus and includes four drum-type photosensitive members (hereinafter, "photosensitive-member 40" unless otherwise specified), 40Y, 40C, 40M, and 40K for the four colors yellow (Y), cyan (C), magenta (M), and black (K) and an intermediate transfer belt 10 on which the image formed on each of the photosensitive members gets transferred at each first transfer position where a roller-type primary transfer device 62 is located.

The belt-speed control device of the image forming apparatus includes a scale 5 (only a portion of it is shown in FIG. 1) having a plurality of scale marks 5*a* and a seam 11 in the circumferential direction. The scale is bonded to the entire surface of the intermediate transfer belt 10, as shown in FIG. 3.

A sensor 6A and a sensor 6B read the scale marks 5*a* of the scale 5 and each of the sensors 6A and 6B outputs an output value. A controller 70 shown in FIG. 1 that functions as a control unit receives the output value and performs feedback control based on the output value to drive the intermediate transfer belt 10 at a uniform speed.

Feedback control involves detecting of the actual speed of the intermediate transfer belt 10 by the sensor 6A and the sensor 6B by reading the scale marks 5*a* of the scale 5, and decreasing or increasing the actual speed of the intermediate transfer belt (hereinafter, "belt speed") to the target speed depending on the actual speed.

Out of the two sensors 6A and 6B, which are used in performing feedback control, the sensor 6A is a primary sensor and the sensor 6B is a secondary sensor. The sensor 6B is located upstream of the sensor 6A in the direction in which the intermediate transfer belt 10 is driven.

The belt-speed control device includes a sensor switching unit (provided in the controller 70 in the embodiment). The sensor switching unit switches over feedback control from the sensor 6A to the sensor 6B in the period spanning from the moment a rear end 11*b* of the seam 11 shown in FIG. 3 crosses the detection position of the sensor 6B (the secondary sensor) up until just before sensor A (the primary sensor) encounters the seam 11.

The color image forming apparatus shown in FIG. 2 has a copier main unit 1 set on a paper feeding table 2. A scanner 3 and an automatic document feeder (ADF) 4 are mounted on the copier main unit 1.

The copier main unit 1 includes a transfer device 20 in its mid portion. The transfer device 20 includes the intermediate transfer belt 10. The intermediate transfer belt 10 is stretched over a driving roller 9 and two driven rollers 15 and 16 and is driven in a clockwise direction in FIG. 2. A belt cleaning device 17 located to the left of the driven roller 15 removes a residual toner remaining after image transfer from the surface of the intermediate transfer belt 10.

The four photosensitive members 40 are located along the direction of movement of the intermediate transfer belt 10 above the straight portion of the intermediate transfer belt 10 stretched between the driving roller 9 and the driven roller 15. Each of the photosensitive members 40 turns in a counter-clockwise direction. The image (toner image) formed on each of the photosensitive members 40 is superposed sequentially on the intermediate transfer belt 10.

Around each photosensitive member 40 are provided a charging device 60, a developing device 61, the primary transfer device 62, a photosensitive member cleaning device 63, and a quenching device 64. An exposing device 21 is provided above the photosensitive member 40.

A secondary transfer device 22 that transfers a sheet P, on which the image on the intermediate transfer belt 10 is recorded, is located below the intermediate transfer belt 10. The secondary transfer device 22 includes a secondary transfer belt 24, which is an endless belt, stretched across two rollers 23 and 23. The secondary transfer belt 24 presses against the secondary roller 16 with the intermediate transfer belt 10 disposed between them. The secondary transfer device 22 transfers the toner images at once from the intermediate transfer belt 10 to the sheet P that is conveyed between the secondary transfer belt 24 and the intermediate transfer belt 10.

A fixing device 25 is located downstream of the sheet conveyance direction with respect to the secondary transfer device 22. The fixing device 25 includes a fixing belt 26, which is an endless belt, and a pressure roller 27 pressed against the fixing belt 26.

The secondary transfer device 22 also performs the function of conveying the sheet P with the image formed thereon to the fixing device 25. A transfer roller or a non-contact charger can also be used as the secondary transfer device 22.

A sheet flipping device 28 that flips the sheet P when images are to be recorded on both sides of the sheet P is located below the secondary transfer device 22.

When taking a color copy using the color copier, an original is normally placed on a document dispenser 30 of the automatic document feeder 4. However, the original can be placed manually after opening the automatic document feeder 4 and placing the original on a contact glass 32 of the scanner 3 and pressing the original against the contact glass 32 by closing the automatic document feeder 4.

When a not shown switch is operated, the original placed on the automatic document feeder 4 is automatically carried to the contact glass 32. If the original is manually placed on the contact glass 32, operating the switch starts a first scanning member 33 and a second scanning member 34 of the scanner 3. A beam from the light source of the first scanning member 33 exposes the original. The light reflected from the original is directed by a mirror of the first scanning member towards the second scanning member. This light hits a pair of mirrors of the second scanning member 34 and flips 1.80° upon hitting the mirrors. This reflected light then passes through an imaging lens 35 and enters a reading sensor 36 that reads the content of the original.

When the start switch is operated, the intermediate transfer belt 10 as well as the photosensitive members 40Y, 40C, 40M, and 40K start turning. Yellow, cyan, magenta, and black images are respectively formed on the photosensitive members 40Y, 40C, 40M, and 40K. The images of each color formed on the photosensitive members 40 are superposed on the intermediate transfer belt 10 that is driven clockwise in FIG. 2 and form a composite full color image.

Meanwhile, a feeding roller 42 of the feeding rung selected from a paper feeding table 2 turns and the sheet P from a selected feeding cassette 44 in a paper bank 43 is rolled out and separated into single sheets by a separating roller 45, and conveyed to a feeding channel 48.

The sheet P comes in contact with a resist roller 49 and comes to a stop for a while.

In the case of manual paper feeding, the sheets P placed in a manual tray 51 are rolled out by a rolling feeding roller 50, separated into single sheets by a separating roller 52, and conveyed to a manual feeding channel 53. The sheet P then comes to a stop upon contact with the resist roller 49.

In either case, the resist roller 49 starts turning synchronous with the color image on the intermediate transfer belt 10 and conveys the sheet P that has come to a halt between the intermediate transfer belt 10 and the secondary transfer device 22 and causes the color image to be transferred to the sheet P by the secondary transfer device 22.

The sheet P bearing the color image is conveyed by the secondary transfer device 22 to the fixing device 25. The fixing device 25 fixes the color image by application of heat and pressure. The sheet P bearing a fixed color image is guided towards the exit by a switching pawl 55 and is ejected by an ejection roller 56 and is stacked on a discharge tray 57.

If "Both sides" mode is selected, the sheet P bearing the color image on one side is conveyed to the sheet flipping device 28 by the switching pawl 55. The sheet flipping device 28 flips the sheet P and reintroduces the sheet P to the transfer position and allows the image to be formed on the reverse side. Once the image formation on the reverse side is completed, the sheet P is ejected to the discharge tray 57 by the ejection roller 56.

Figure 4:
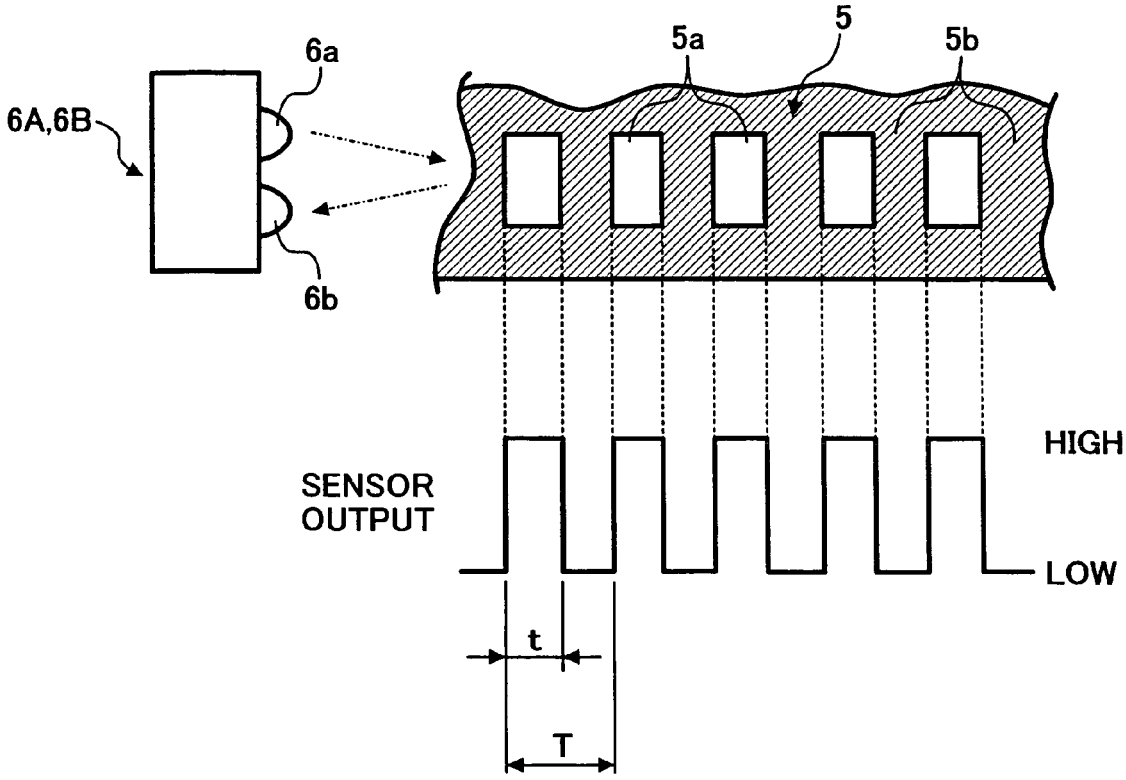
FIG. 4 depicts two values output by the sensors shown in FIG. 3 upon reading scale marks of a scale.
Figure 5:
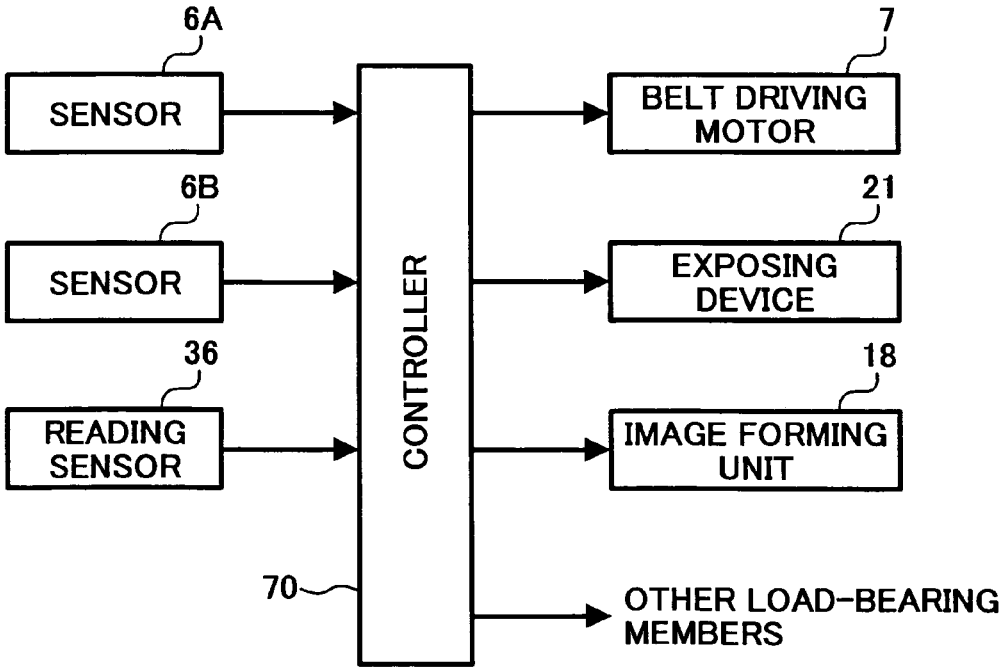
FIG. 5 is a block diagram of a controller of the image forming apparatus shown in FIG. 2.

As shown in FIG. 3, the sensor 6A and the sensor 6B are set on the edge at a distance of Lp from each other, respectively in the direction of the belt movement, and read the scale 5 (also see FIG. 4) provided on the entire surface of the intermediate transfer belt 10 (the scale 5 can also be provided on the underside of the intermediate transfer belt 10). The distance Lp is a mechanically set distance at the time of designing and corresponds to the distance from the edge of the sensor 6B where the intermediate transfer belt 10 enters and the edge of the sensor 6A where the intermediate transfer belt 10 emerges. As shown in FIG. 5, the controller 70 detects the actual speed of the intermediate transfer belt 10 from the data output by the sensor 6A and the sensor 6B upon reading of the scale marks 5*a* of the scale 5, and adjusts the actual speed of the intermediate transfer belt 10 to the target speed (standard speed) by controlling a belt driving motor 7.

The controller 70 includes a micro-computer consisting of a central processing unit (CPU), a read-only memory (ROM), a random access memory (RAM), and an input/output (I/O) circuit. The CPU of the micro-computer performs functions related to determining processes and other processes. The ROM stores programs and data required for the various processes. The RAM is a data memory for storing process data.

The controller 70 is connected to the sensor 6A and the sensor 6B as well as the belt driving motor 7 so that it can perform feedback control of the belt speed.

The controller 70 is also connected to the reading sensor 36, the exposing device 21 and an image forming unit 18 so that it can control the optical writing based on a detection result of the reading sensor and formation of the toner images in four colors by development, superposing and intermediate transfer. Apart from these, the controller 70 is connected to load-bearing members such as the driving system, etc.

The driving system of the intermediate transfer belt 10 and the belt speed detecting system of the intermediate transfer belt 10 are explained next.

As shown in FIG. 1, the torque of the belt driving motor 7 stretches and relays the intermediate transfer belt 10 to the driving roller 9 so that the intermediate transfer belt 10 can be driven. The intermediate transfer belt 10 is composed of fluoric resin, polycarbonate resin, polyimide resin, etc. All the layers or some of the layers of the intermediate transfer belt 10 can be made of an elastic material.

The belt driving motor 7 drives the intermediate transfer belt 10 in the direction of the arrow C by turning the driving roller 9. The torque can be relayed from the belt driving motor 7 to the driving roller 9 directly or via a gear system.

The scale 5 is provided on the entire surface of the intermediate transfer belt 10 (in FIG. 3 only the vicinity of the seam 11 is shown). The position of the scale 5 in the width direction of the intermediate transfer belt 10 corresponds to the edge of the photosensitive member 40 and falls in the non-image forming area.

The sensor 6A and the sensor 6B are identical. As shown in FIG. 4, both the sensor 6A and the sensor 6B are reflective optical sensors, each consisting of a pair of photo emitter 6*a* and photo receiver 6*b*. The photo emitter 6*a* emits light towards the scale 5 and the photo receiver 6*b* receives the light reflected from the scale 5. The sensor 6A and the sensor 6B detect the difference in the amount of reflected light from the region of the scale 5 having the scale mark 5*a* and a region 5*b* having no scale mark.

In other words, the sensor 6A and the sensor 6B output signals having two values, namely High and Low, based on the difference in the reflection rate from the region of the scale 5 having the scale mark 5*a* and the region 5*b* having no scale mark.

For example, if it is assumed that the sensor 6A and the sensor 6B output High signal when the photo receiver receives light, and if the reflection rate from the region of the scale 5 having the scale mark 5*a* is higher than from the region 5*b* having no scale mark, in the signal output by the sensor 6A or the sensor 6B, the range denoted by "t" in FIG. 4 denotes the output when the scale mark 5*a* has crossed the sensor 6A or the sensor 6B. Accordingly, as the intermediate transfer belt 10 is driven, the sensor 6A and the sensor 6B output either High or Low signal depending on whether a region having the scale mark 5*a* or the region 5*b* with no scale mark has crossed the sensor 6A and the sensor 6B.

The speed of movement of the intermediate transfer belt 10 (belt speed) can be detected by determining a period T from the instant the signal turns from Low to High to the instant when the signal next turns Low or High.

Any type of sensor or scale can be used as long as it is possible to detect the belt speed by reading the scale on the intermediate transfer belt 10.

Figure 6:
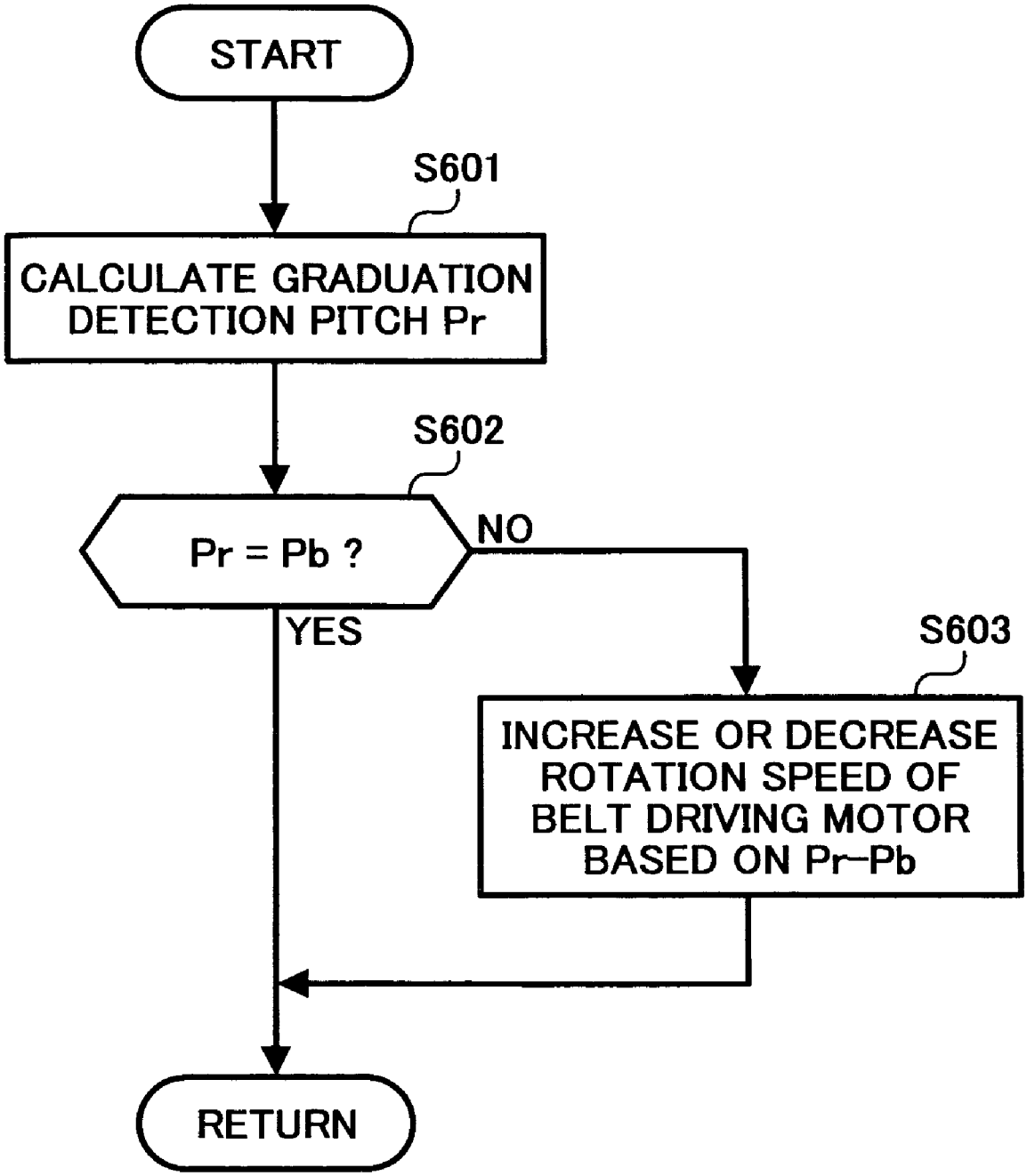
FIG. 6 is a flow chart of a belt speed feedback control routine performed by the controller shown in FIG. 5.

The controller 70 shown in FIG. 5 performs the basic feedback control of the belt speed by implementing the routine shown in FIG. 6. That is, the controller 70 calculates a graduation detection pitch Pr based on an output voltage value output by the sensor 6A or the sensor 6B (step S601) (the selection of the sensor 6A or the sensor 6B is explained later). The controller 70 performs the calculation by counting the difference between the rising portions of the High voltages (see FIG. 4) or the falling portions of the Low voltages.

The controller 70 then determines whether the graduation detection pitch Pr obtained by calculation is equal to a basic pitch value Pb (T in FIG. 4 in this example) (step S602). If Pr is found to be equal to Pb ("Yes" at step S602), the controller 70 determines that no change has occurred in the belt speed and returns to the main routine. If Pr is found to be not equal to Pb ("No" at step S602), the controller 70 determines that a change has occurred in the belt speed and increases or decreases the rotation speed of the belt driving motor 7 by the ratio corresponding to the value "Pr-Pb" (step S603).

Thus, the color image forming apparatus prevents any variation in the belt speed by performing feedback control of the belt driving motor 7 based on the result obtained by comparing the graduation detection pitch Pr and the basic pitch value Pb.

If the value of "Pr-Pb" is positive, the controller 70 speeds up the belt driving motor 7 by the ratio corresponding to the obtained value. Conversely, if the value of "Pr-Pb is negative, the controller 70 slows down the belt driving motor 7 by the ratio corresponding to the obtained value.

The controller 70 entirely performs feedback control of the intermediate transfer belt 10, thus preventing variation in the belt speed and the resulting image degradation due to shifted superposition of the toner images.

When the belt-shaped long scale 5 is bonded to the surface of the intermediate transfer belt 10, even if the scale 5 itself is of accurate length, due to variation in the perimeter of the intermediate transfer belt 10, a gap S shown in FIG. 3 can be formed at the seam 11 between one end (front end 11*a*) of the seam 11 and the other end (rear end 11*b*) of the seam 11.

If such a gap is formed at the seam 11 of the scale 5, the interval between a scale mark 5*a*', which is a high reflectance region closest to the seam 11 at the front end 11*a* side, and a scale mark 5*a*", which is a high reflectance region closest to the seam 11 at the rear end 11*b* side, becomes larger than the intervals between scale marks 5*a* in regions other than at the seam 11.

Therefore, at the seam 11, the occurrence time of the rising portion of the High voltage and the falling portion of the Low voltage, explained with reference to FIG. 4, gets delayed to the extent of the gap S at the seam 11.

As a result, the graduation detection pitch Pr, which corresponds to a length L3 obtained by adding a length L1 of the scale mark 5*a* and a length L2 of the region 5*b* having no scale mark, becomes Pr' at the seam 11, which is obtained by adding the length of the gap S to the graduation detection pitch Pr.

Thus, the pitch between the scale mark 5*a*' and the scale mark 5*a*" changes from the normal graduation detection pitch Pr to Pr', forming an abnormal pitch region, even if the belt speed has not changed.

When encountering the abnormal pitch region at the seam 11, the controller 70 mistakenly determines that the belt speed has fallen and performs feedback control, speeding up the belt. Consequently, the superposition of the toner images transferred to the intermediate transfer belt 10 is shifted leading to color inconsistency in the image.

Therefore, in the color image forming apparatus according to the embodiment, by providing two sensors, the sensor 6A and the sensor 6B, and switching over the control of belt speed from the sensor 6A to the sensor 6B in the period spanning from the moment the rear end of the seam 11 crosses the detection position of the sensor 6B up until just before the sensor 6A encounters the seam 11, uniform belt speed is maintained even when the seam 11 is encountered. Consequently, shift in the superposition of the toner images and the resulting image degradation due to color inconsistency can be prevented.

Figure 8:
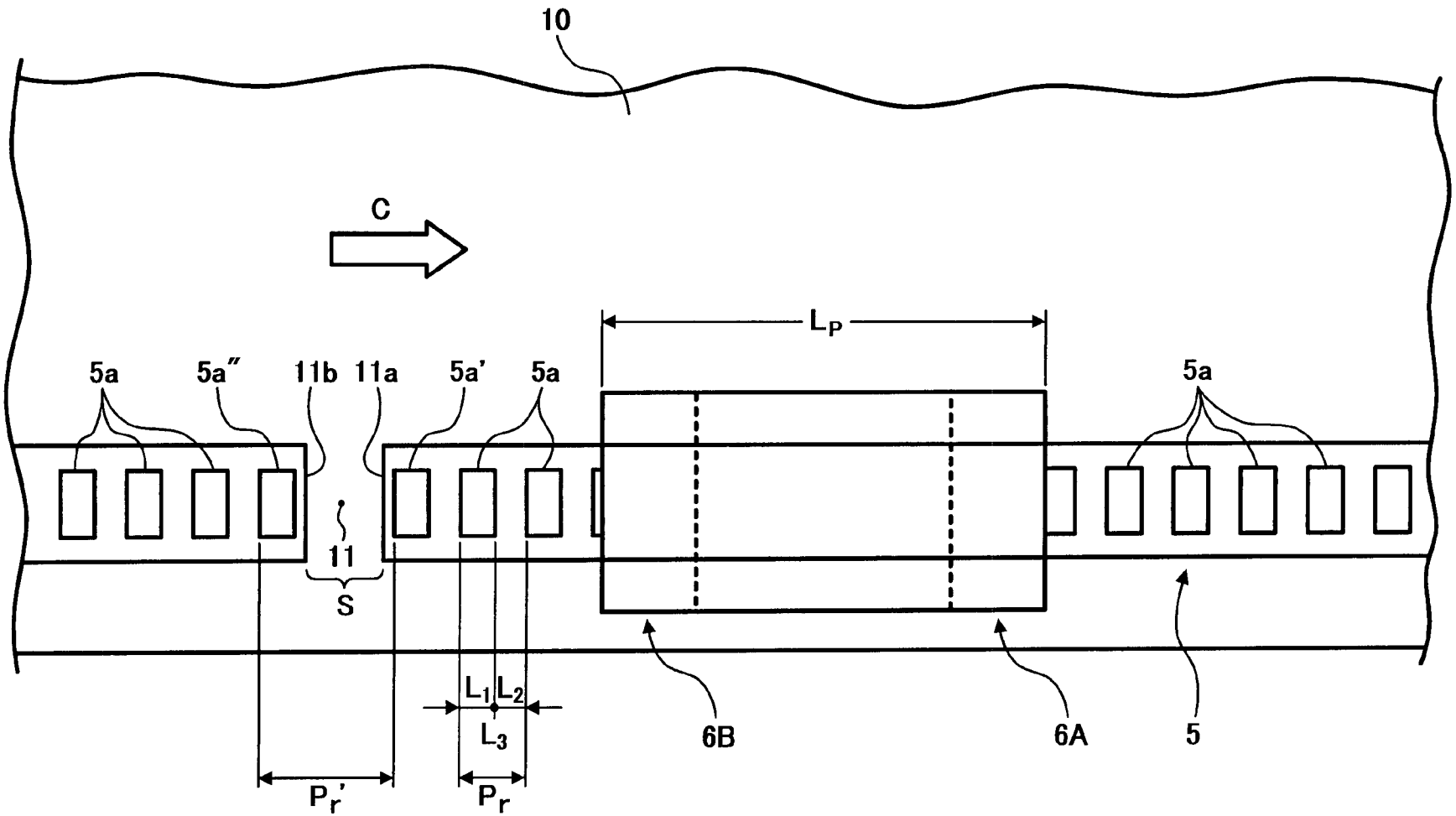
FIG. 8 is a top view of the two sensors shown in FIG. 3 integrated into a single unit.
Figure 9:
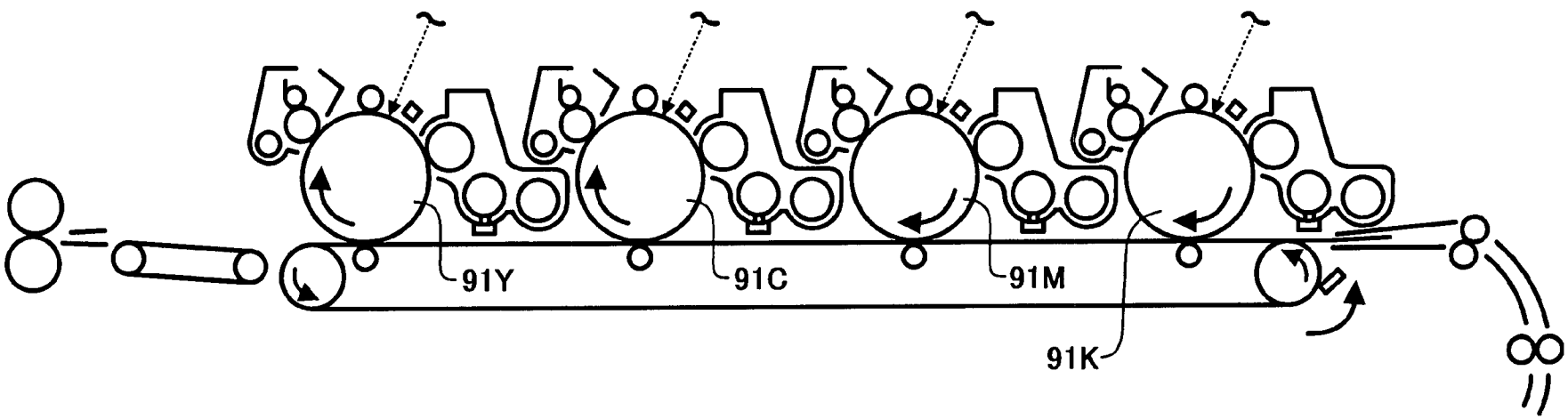
FIG. 9 depicts an image forming unit of a conventional image forming apparatus employing a direct transfer method.
Figure 10:
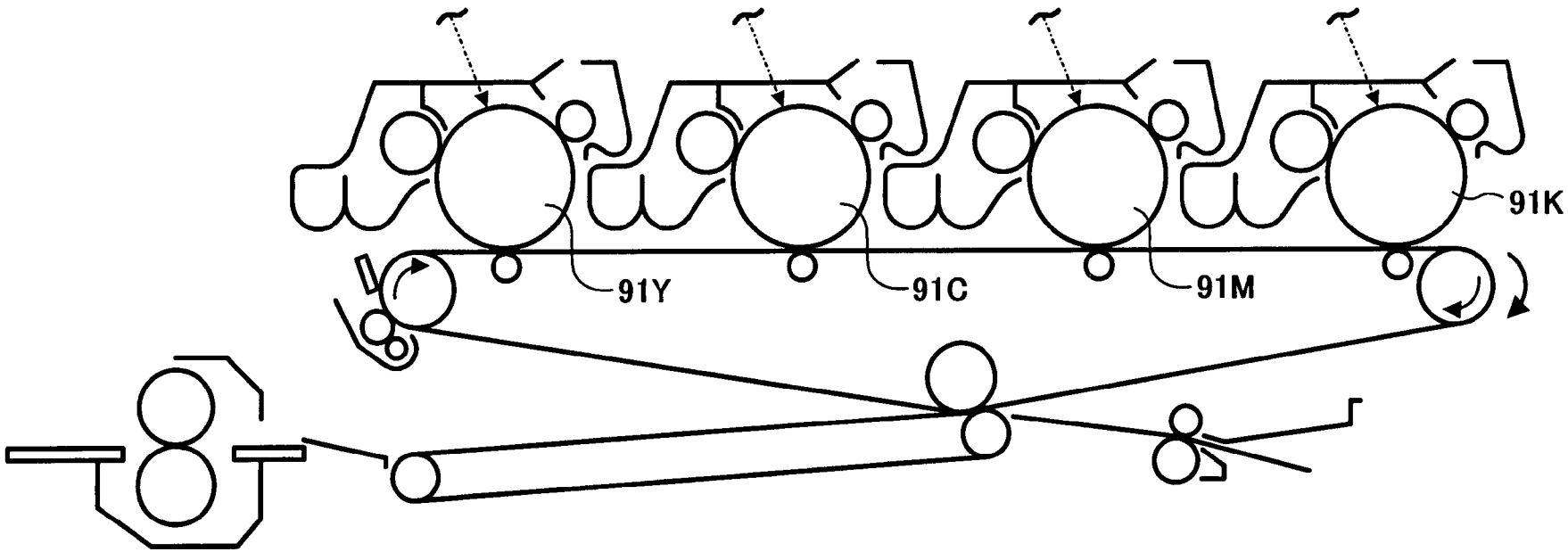
FIG. 10 depicts an image forming unit of a conventional image forming apparatus employing an indirect transfer method.
Figure 11:
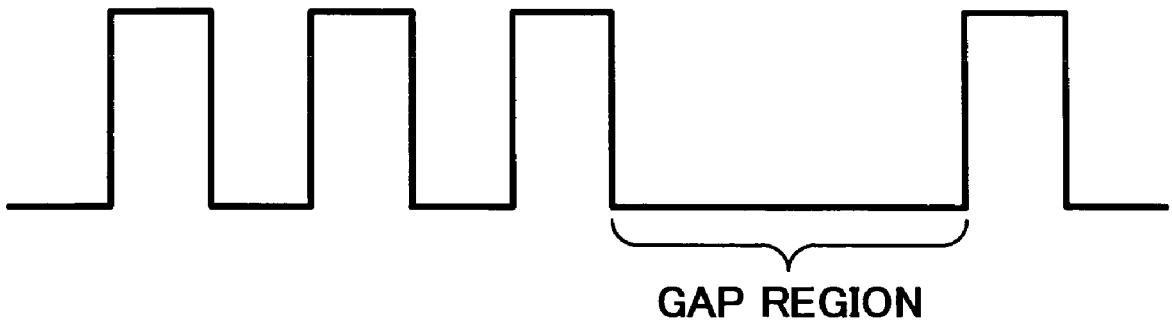
FIG. 11 depicts a detection pulse output by a sensor upon reading a scale seal with a gap.
Figure 12:
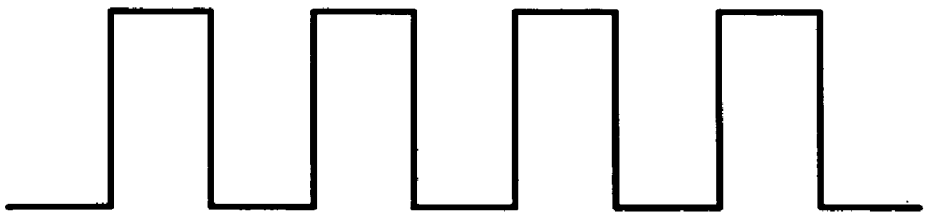
FIG. 12 depicts a detection pulse output by a sensor upon reading a scale seal without a gap.
Figure 13:
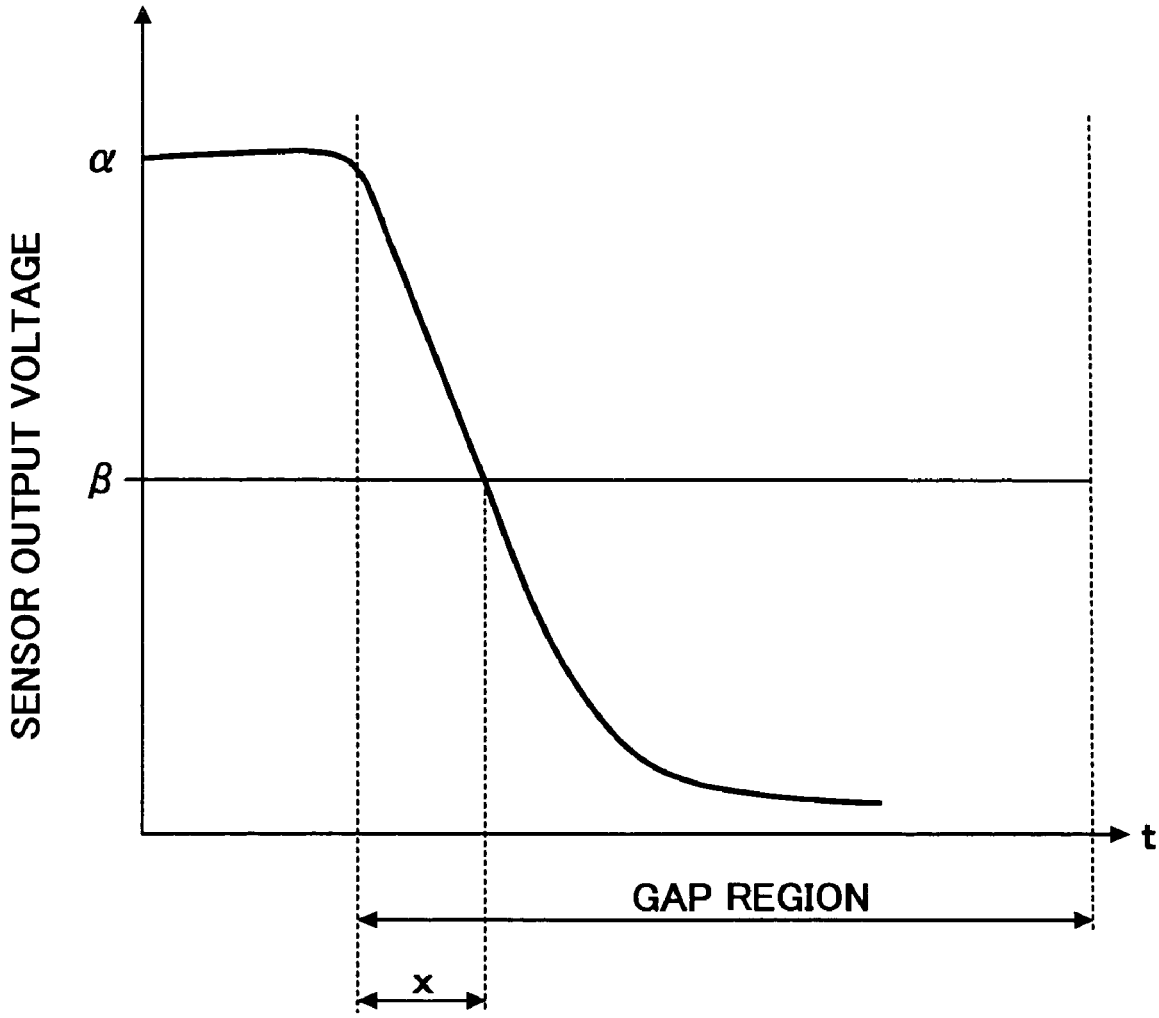
FIG. 13 is a waveform diagram illustrating a change in voltage output by the sensor when the sensor encounters the gap of the scale seal as depicted with reference to FIG. 11.

The distance Lp between the sensor 6A and the sensor 6B is a mechanically set distance at the time of designing. The sensor 6A and the sensor 6B need not be two separate entities, as shown in FIG. 3, but can be integrated into a single unit. FIG. 8 is a top view of two sensors integrated into a single unit. Integrating two sensors into a single unit as shown in FIG. 8 helps avoid shifting of the sensors over long periods of use and maintain a constant distance Lp between the sensors. As a result, the control is switched between the sensors without delay and a uniform speed of the intermediate transfer belt 10 can be maintained.

Figure 7:
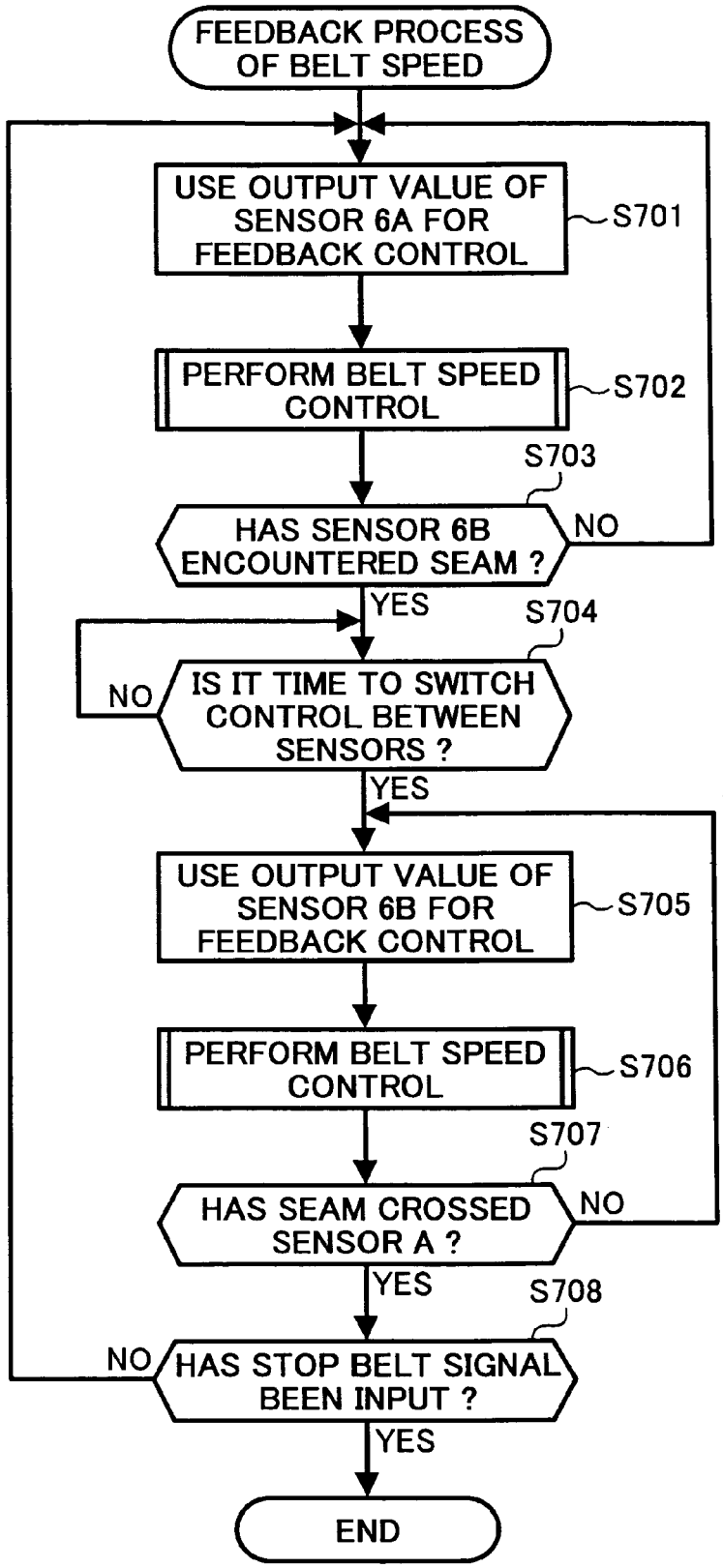
FIG. 7 is a flow chart of the belt speed feedback control routine performed by switching between the two sensors shown in FIG. 3.

FIG. 7 is a flow chart of the belt speed feedback control routine performed by implementing the belt speed control method involving switching the control of the speed belt between the two sensors.

When a program related to the feedback control process of the belt speed is initiated, the controller 70 assigns control of belt speed to the sensor 6A and uses the output value of the sensor 6A to perform feedback control (step S701). The controller 70 performs the belt speed control (the basic feedback control of belt speed) explained with reference to FIG. 6 based on the output value of the sensor 6A (step S702).

Next, the controller 70 determines whether the sensor 6B has encountered the seam 11, that is, whether the rear end 11*b* of the seam 11 has crossed the detection position of the sensor 6B (step S703). If it is determined that the rear end 11*b* has not crossed the sensor 6B ("No" at step S703), the process returns to step S701.

If it is determined that the rear end 11*b* has crossed the detection position of the sensor 6B ("Yes" at step S703), the controller 70 determines whether it is time to switch over the control of the belt speed to the sensor 6B (step S704).

The switching time spans from the instant the rear end 11*b* of the seam 11 crosses the detection position of the sensor 6B up until just before the sensor 6A encounters the seam 11. More specifically, the switching time corresponds to a period spanning from the time the length of the intermediate transfer belt 10 corresponding to the gap S of the seam 11 crosses the sensor 6B after the sensor 6B encounters the front end 11*a* of the seam 11 on the intermediate transfer belt 10 up until just before the length of the intermediate transfer belt 10 corresponding to the gap S of the seam 11 traverses the distance Lp (more accurately, the distance obtained after deducting the width of the sensor 6A from the distance Lp) between the sensor 6B and the sensor 6A after the sensor 6B encounters the front end 11*a* of the seam 11 on the intermediate transfer belt 10.

For example, assuming that the time taken by the intermediate transfer belt 10 to traverse the distance Lp is 70 ms, and that there are ten scale marks 5*a* in the distance Lp, it can be surmised that it takes 7 ms for the intermediate transfer belt 10 to traverse the distance corresponding to one scale mark 5*a*. When the intermediate transfer belt 10 traverses the distance up to the 9th scale mark 5*a*, 63 ms would have elapsed. The controller 70 switches over the control from the sensor 6A to the sensor 6B after 60 ms have elapsed, that is, 3 ms before the intermediate transfer belt 10 traverses the distance corresponding to nine scale marks 5*a*.

When the seam 11 crosses the sensor 6B, the controller 70 determines the time required for the seam 11 to traverse the pre-stored distance Lp between the sensor 6B and the sensor 6A and sets, as the switching time, the time immediately before the seam 11 reaches the sensor 6A.

If it is determined that it is not yet time for switching over the control of the belt speed to sensor B ("No" at step S704), the controller 70 repeats the process until it is time to switch over the control. If it is determined that it is time to switch over the control to the sensor 6B ("Yes" at step S704), the controller 70 assigns control of the speed belt to the sensor 6B and uses the output value of the sensor 6B for performing feedback control of the belt speed (step S705). The controller 70 performs the belt speed control (the basic feedback control of belt speed) explained with reference to FIG. 6 based on the output value of the sensor 6B (step S706).

Next, the controller 70 determines whether the seam 11 has completely crossed the detection position of the sensor 6A (step S707). The seam 11 completely crossing the detection position of the sensor 6A indicates that the intermediate transfer belt 10 has traversed a distance which is greater than the distance obtained by adding the gap S at the seam 11 to the distance Lp, which is the distance between the sensor 6A and the sensor 6B, after the sensor B detects the front end 11*a* of the seam 11 on the intermediate transfer belt 10.

If it is determined that the seam 11 has not completely crossed the detection position of the sensor 6A ("No" at step S707), the process returns to step S705. If it is determined that the seam 11 has completely crossed the sensor 6A ("Yes" at step S707), the controller 70 determines whether a stop belt signal has been input (step S708). The stop belt signal is a signal that stops the intermediate transfer belt 10. If it is determined that no stop belt signal has been input ("No" at step S708), the process returns to step S701 as the image forming operation continues uninterrupted, where the controller 70 reassigns control of the belt speed to the sensor 6A, and performs feedback control of the belt speed based on the output value of the sensor 6A. The subsequent steps are repeated.

If it is determined that the stop belt signal has been input ("Yes" at step S708), the process is ended.

Thus, in the embodiment, when the sensor 6B encounters the seam 11, feedback control of the belt speed is performed based on the output value of the sensor 6A. When the seam 11 reaches the sensor 6A, the output value of the sensor 6A, which would be inaccurate due to the abnormal pitch region at the seam 11 being read by the sensor 6A, is not used, and instead the output value of the sensor 6B, which would be accurate, is used for performing feedback control of the belt speed. Consequently, by switching over the control of the belt speed to the sensor that is not affected by the seam 11, uniform belt speed is maintained even if the seam 11 is detected the front end 11*a* of the seam 11 has crossed the sensor. As a result, degradation of image quality due to shifted toner images can be prevented.

Furthermore, the belt speed can be controlled accurately with a software that helps maintain a uniform belt speed based on the signal from the sensors. Thus, the need for a complex software is obviated.

Apart from the aforementioned switching time determination method, the control of belt speed can also be switched over from the sensor 6B back to the sensor 6A when the sensor 6A detects input of a normal detection signal (a signal from the region having the equidistant scale marks 5*a*).

The control of the belt speed can be switched from the sensor 6B to the sensor 6A at any timing as long as the seam 11 has completely crossed the sensor 6A, and therefore, there is no need to provide a counter for counting time for this switching. However, the control of the belt speed should be switched back to the sensor A until the seam 11 is detected by the sensor B in the next-lap.

It is preferable to time the switching of the control from the sensor 6B to the sensor 6A when image formation is not taking place after the seam 11 has crossed the sensor 6A rather than when image formation is taking place, as the control of belt speed is not affected, so that the final image is not adversely affected.

In the embodiment, the time just before the seam 11 reaches the sensor A after traversing the pre-stored distance Lp between the sensor 6B and the sensor 6A is set as the time for switching the control of the belt speed from one sensor to the other. When the belt speed varies, such as when the belt driving motor 7 is started up, the time when the seam 11 is about to cross the sensor 6A or cross past the sensor 6A does not remain constant, thus leading to improper control of belt speed.

Therefore, when the belt driving motor (driving source that drives the belt) 7 is just started up and its speed tends to vary, it is preferable to halt the intermediate transfer belt 10 in such a way that the seam 11 does not lie between the sensor 6A and the sensor 6B or very close to either the sensor 6A or the sensor 6B. This control is also performed by the controller 70.

An image forming program executed by the image forming apparatus according to the embodiment can be made readily available on a read-only memory (ROM).

The image forming program executed by the image forming apparatus according to the embodiment can be recorded in an installable format on a computer-readable recording medium such as a compact disk-read-only memory (CD-ROM), flexible disk (FD), compact disk-recordable (CD-R), digital versatile disk (DVD), etc.

The image forming program executed by the image forming device according to the embodiment can be stored on a computer connected to a network, such as the Internet, and can be downloaded via the network. The image forming program can be provided or distributed via the network.

The image forming program executed by the image forming apparatus according to the embodiment can be in the form of a module that includes the controller 70. The CPU (processor) reads the image forming program from the ROM and loads the controller 70 to a primary storage device to generate the controller 70 on the primary storage device.

The present invention has wide application as an image forming apparatus having a belt-speed control device, a program for belt speed control, and a belt speed control method.

According to an aspect of the present invention, a belt speed can be accurately controlled without requiring complex software, so that misalignment of toner images can be reliably prevented.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A device for controlling speed of a belt, wherein a scale including a plurality of equally spaced marks is attached to the belt in a direction of movement of the belt such that a gap is formed between a first end and a second end of the scale, the device comprising:

a first sensor configured to detect the marks on the scale and output a first signal upon detecting a mark among the marks;

a second sensor configured to detect the marks on the scale and output a second signal upon detecting a mark among the marks, wherein the first sensor and the second sensor are located at different positions along the direction;

said first and second sensors being configured to detect said gap; and a controlling unit that controls the speed based on any one of the first signals and the second signals according to a position of the gap detected by the first sensor and the second sensor, wherein the controlling unit switches from controlling the speed based on the first signals to controlling the speed based on the second signals at a timing immediately before the first end reaches the first sensor, wherein the timing is calculated when the second sensor detects the first end based on the distance corresponding to the space between the first sensor and the second sensor.

2. The device according to claim 1, wherein the second end is positioned upstream than the first end in the direction, the second sensor is positioned upstream than the first sensor in the direction, and the controlling unit switches from controlling the speed based on the first signals to controlling the speed based on the second signals after the second sensor detects the second end and before the first sensor detects the first end.

3. The device according to claim 1, wherein the controlling unit switches from controlling the speed based on the first signals to controlling the speed based on the second signals after the first end moves a distance corresponding to the gap from when the second sensor detects the first end and before the first end moves a distance corresponding to a space between the first sensor and the second sensor from when the second sensor detects the first end.

4. The device according to claim 1, wherein the controlling unit controls the belt such that the gap is not positioned between the first sensor and the second sensor while a driving source that drives the belt is starting up.

5. A device for controlling speed of a belt, wherein a scale including a plurality of equally spaced marks is attached to the belt in a direction of movement of the belt such that a gap is formed between a first end and a second end of the scale, the device comprising:

a first sensor configured to detect the marks on the scale and output a first signal upon detecting a mark among the marks;

a second sensor configured to detect the marks on the scale and output a second signal upon detecting a mark among the marks, wherein the first sensor and the second sensor are located at different positions along the direction;

said first and second sensors being configured to detect said gap; and a controlling unit that controls the speed based on any one of the first signals and the second signals according to a position of the gap detected by the first sensor and the second sensor, wherein the second end is positioned upstream than the first end in the direction, the second sensor is positioned upstream than the first sensor in the direction, and the controlling unit switches from controlling the speed based on the second signals to controlling the speed based on the first signals after the first end moves a distance corresponding a space between the first sensor and the second sensor in addition to a distance corresponding to the gap from when the second sensor detects the first end.

6. An image forming apparatus comprising:

an image forming unit that forms images by movement of a belt, wherein a scale including a plurality of equally spaced marks is attached to the belt in a direction of movement of the belt such that a gap is formed between a first end and a second end of the scale; and a device that controls speed of the belt, including a first sensor configured to detect the marks on the scale and output a first signal upon detecting a mark among the marks;

a second sensor configured to detect the marks on the scale and output a second signal upon detecting a mark among the marks, wherein the first sensor and the second sensor are located at different positions along the direction;

said first and second sensors being configured to detect said gap; and a controlling unit that controls the speed based on any one of the first signals and the second signals according to a position of the gap detected by the first sensor and the second sensor, wherein the controlling unit switches from controlling the speed based on the first signals to controlling the speed based on the second signals at a timing immediately before the first end reaches the first sensor, wherein the timing is calculated when the second sensor detects the first end based on the distance corresponding to the space between the first sensor and the second sensor.

7. The image forming apparatus according to claim 6, wherein the second end is positioned upstream than the first end in the direction, the second sensor is positioned upstream than the first sensor in the direction, and the controlling unit switches from controlling the speed based on the first signals to controlling the speed based on the second signals after the second sensor detects the second end and before the first sensor detects the first end.

8. The image forming apparatus according to claim 6, wherein the controlling unit switches from controlling the speed based on the first signals to controlling the speed based on the second signals after the first end moves a distance corresponding to the gap from when the second sensor detects the first end and before the first end moves a distance corresponding to a space between the first sensor and the second sensor from when the second sensor detects the first end.

9. The image forming apparatus according to claim 6, wherein the second end is positioned upstream than the first end in the direction, the second sensor is positioned upstream than the first sensor in the direction, and the controlling unit switches from controlling the speed based on the second signals to controlling the speed based on the first signals after the first end moves a distance corresponding a space between the first sensor and the second sensor in addition to a distance corresponding to the gap from when the second sensor detects the first end.

10. The image forming apparatus according to claim 6, wherein the controlling unit controls the belt such that the gap is not positioned between the first sensor and the second sensor while a driving source that drives the belt is starting up.

* * * * *